US005222312A

United States Patent [19]

Doyle

[11] Patent Number: 5,222,312

[45] Date of Patent: Jun. 29, 1993

[54] SHOE WITH PNEUMATIC INFLATING DEVICE

[76] Inventor: Harold S. Doyle, 7762 Ramsgate Cir. S., Hannover Park, Ill. 60103

[21] Appl. No.: 954,568

[22] Filed: Sep. 30, 1992

Related U.S. Application Data

[63] Continuation-in-part of Ser. No. 712,591, Jul. 2, 1991.

[51] Int. Cl.[5] ..... A43B 13/20

[52] U.S. Cl. ..... 36/28; 36/29

[58] Field of Search ..... 36/3 B, 28, 27, 29, 36/7.8, 117

[56] References Cited

U.S. PATENT DOCUMENTS

| | | | |
|---|---|---|---|
| 1,313,924 | 8/1919 | Stewart | 36/29 |
| 2,558,973 | 7/1951 | Meaker | 36/3 B |
| 4,133,118 | 1/1979 | Khalsa et al. | 36/29 X |
| 4,137,653 | 2/1979 | Famolare, Jr. | 36/3 B |
| 4,420,893 | 12/1983 | Doak | 36/29 |
| 4,662,087 | 5/1987 | Beuch | 36/88 |
| 4,674,200 | 6/1987 | Sing | 36/29 X |
| 4,763,426 | 8/1988 | Polus et al. | 36/29 |
| 4,912,861 | 4/1990 | Huang | 36/29 |
| 4,918,838 | 4/1990 | Chang | 36/29 X |
| 4,995,173 | 2/1991 | Spier | 36/29 |
| 4,999,932 | 3/1991 | Grim | 36/29 X |
| 5,074,765 | 12/1991 | Pekar | 36/29 X |
| 5,113,599 | 5/1992 | Cohen et al. | 36/29 X |

FOREIGN PATENT DOCUMENTS

| | | | |
|---|---|---|---|
| 1164720 | 10/1958 | France | 36/29 |
| 2252820 | 12/1973 | France . | |
| 2496423 | 6/1982 | France | 36/29 |

OTHER PUBLICATIONS

PCT WO89/10074 Nov. 1989 (Sadler).

*Primary Examiner*—Jimmy G. Foster
*Assistant Examiner*—Ted Kavanaugh
*Attorney, Agent, or Firm*—Lee, Mann, Smith, McWilliams, Sweeney & Ohlson

[57] ABSTRACT

A pneumatic inflating device disposed within the sole of a shoe includes a plurality of pairs of oppositely disposed hollow chambers within the sole of the shoe, a plurality of inflatable air cells, each air cell disposed within one of said hollow chambers, a pump assembly attached to the shoe, a plurality of tubes connecting the air cells to the pump assembly, means for restricting air flow out of the air cells, and means for releasing air from the pneumatic inflating device. The means for restricting air flow out of the air cells includes a nipple disposed at the end of each branch of the tubes. The means for releasing air from the pneumatic inflating device includes a release valve. The pneumatic inflating device can further include means for locking the pump assembly in a closed position.

16 Claims, 2 Drawing Sheets

SHOE WITH PNEUMATIC INFLATING DEVICE

This is a continuation in part of my U.S. patent application Ser. No. 07/712,591, filed Jul. 2, 1991 still pending, entitled PNEUMATIC BOUNCING SOLE, which is incorporated by reference herein.

BACKGROUND OF THE INVENTION

This invention relates to a shoe having a pneumatic inflating device disposed within the sole which allows for greater comfort and an increase in vertical bounce of the wearer. Previous shoe arrangements have included soles that can be inflated at the arch to provide support thereof. Some shoes contain soles which have sealed inflated chambers disposed therein to increase vertical bounce. Still other soles include chambers which can be inflated using an external inflation source. These previous shoes have not allowed for ready individual adjustment and often result in uneven air distribution.

SUMMARY OF THE INVENTION

The present invention provides for a self-contained built-in pneumatic inflating device in each shoe sole capable of generating, controlling and distributing air pressure within the sole of the shoe to provide for increased vertical jump and comfort. The preferred embodiment includes a plurality of pairs of oppositely disposed air cells distributed along the entire length of the sole, a pump attached to the shoe for immediate inflation of the air cells, a distribution manifold, and a release mechanism.

DETAILED DESCRIPTION OF THE PREFERRED EMBODIMENT

Figure 1:
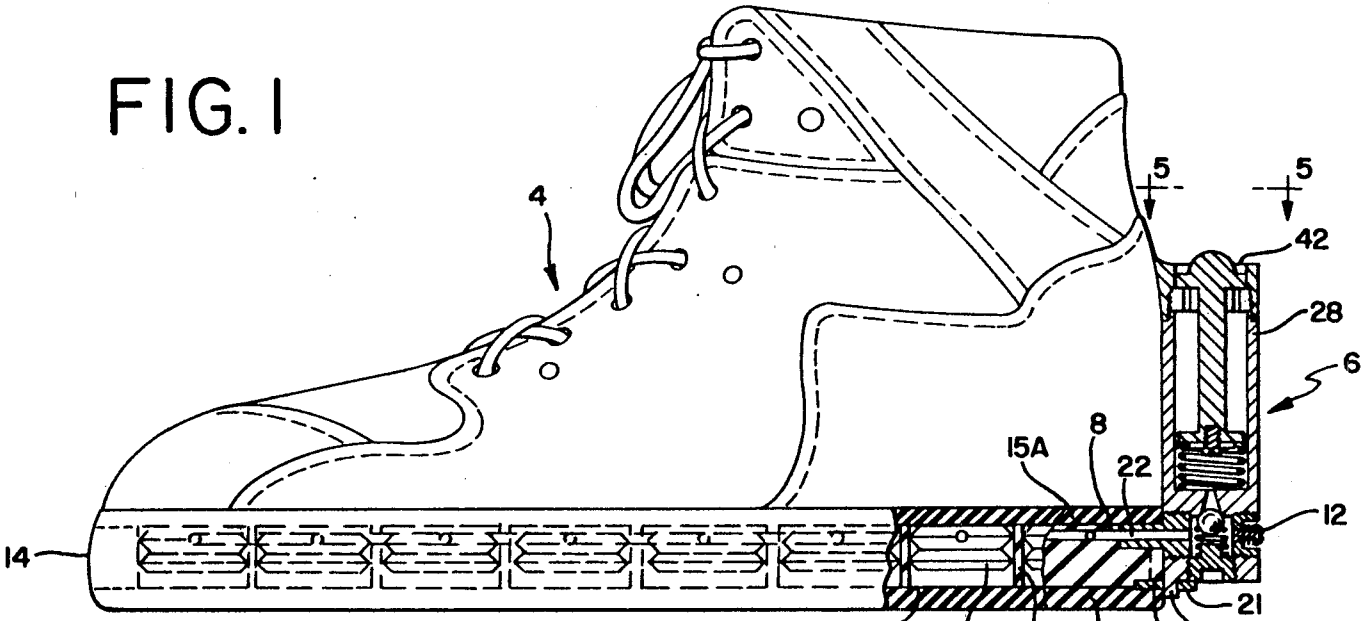
FIG. 1 is a side view, partially broken away, of the shoe and inflating device of the present invention.

The present invention is directed to a shoe with a pneumatic inflating device disclosed therein generally depicted with the number 2. As shown in FIG. 1, the pneumatic inflating device is attached to a shoe 4 and includes a pump assembly 6, a distribution manifold assembly 8, a plurality of pairs of air cells 10, and a release valve assembly 12.

Figure 2:
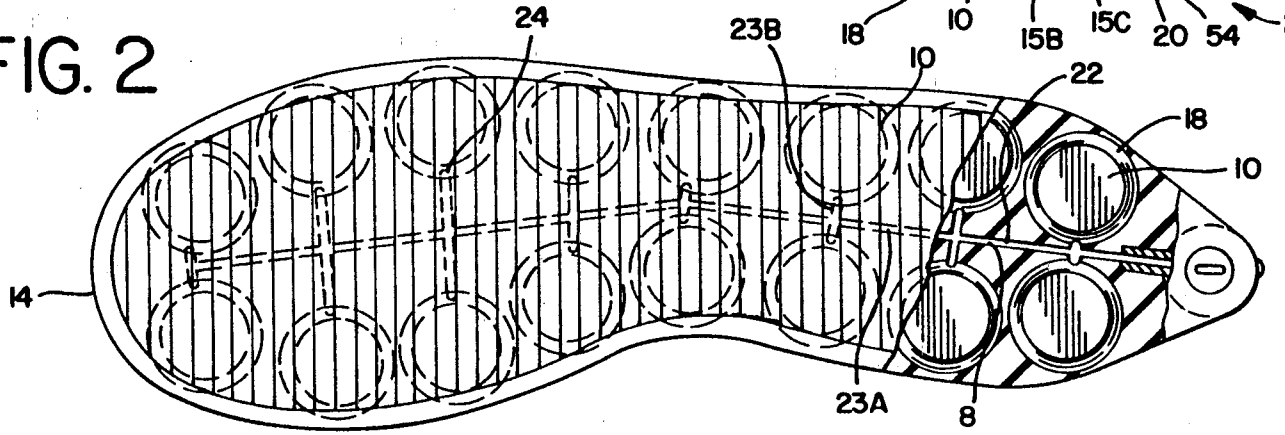
FIG. 2 is a bottom view, partially cut away, of the sole of the present invention.

The shoe 4 includes a sole 14 that includes an upper sole 15A, a center sole 15B and a lower sole 15C. The upper and lower soles 15A and 15C respectively are made of the same material and are one-quarter (¼") inch thick. The center sole 15B is made of three-quarter (¾") inch rubber foam or other flexible, compressible material and includes a plurality of hollow chambers 18 disposed therethrough. As seen in FIG. 2, the hollow chambers 18 are arranged in oppositely disposed pairs along the entire length of the shoe sole 14. The function of these hollow chambers 18 will be apparent herein.

The center sole 15B also includes a plurality of formed canals (not shown) on the upper surface thereof, connecting the hollow chambers 18. The function of these canals will be later apparent. A U-shaped plate 20 is disposed between the center sole 15B and the lower sole 15C and extends exterior to the sole 14 under the pump assembly 6. A slot 21 is disposed through the portion of the U-shaped plate 20 that extends exterior to the sole 14. The U-shaped plate 20 provides support for the pump assembly 6 during pumping action.

As best seen in FIG. 1, an air cell 10 is disposed within each of the hollow chambers 18, thus providing a plurality of pairs of oppositely disposed air cells 10 along the entire length of the sole 14. The air cells 10 are one inch in diameter and have a height of three-quarter (¾") inch. The air cells 10 are made from a rubber based product, such as KEVLAR® by duPont or inflatable rubber, and are reinforced by a plurality of radial cord rings (not shown). These rings are usually constructed of nylon but can be constructed of any other suitable material known to one having ordinary skill in the art. The air cells 10 of the preferred embodiment are capable of withstanding pressure of up to 100 psi. The air cells 10 are connected to the pump assembly 6 by a distribution manifold 8. The distribution manifold 8 includes a plurality of pneumatic tubes 22 disposed within the formed canals on the upper surface of the center sole 15B. The pneumatic tubes 22 are arranged such that a central tube 23A extends along the entire length of the shoe 4 and a plurality of branch tubes 23B diverge from the central tube 23A. Each branch tube 23B is connected to one air cell 10. Such an arrangement allows for the air cells 10 to be connected in parallel such that if one branch tube 23B is obstructed, the remaining branch tubes 23B and corresponding cell remain substantially functional. A nipple 24 is disposed at the end of each of the branch tubes 23B at the entrance to each of the air cells 10. In the preferred embodiment, the nipples 24 include a one-eighth (⅛") inch orifice to choke the flow of air into and out of the air cells 10 although other diameters can be used. Additionally, the nipples can include valves which open and close in response to pressure. These nipples 24 prevent sudden transfers of air between the cells 10 in the toe and heel areas of the sole 14, thus maintaining even pressure throughout walking, running, and high bouncing activities.

Figure 3:
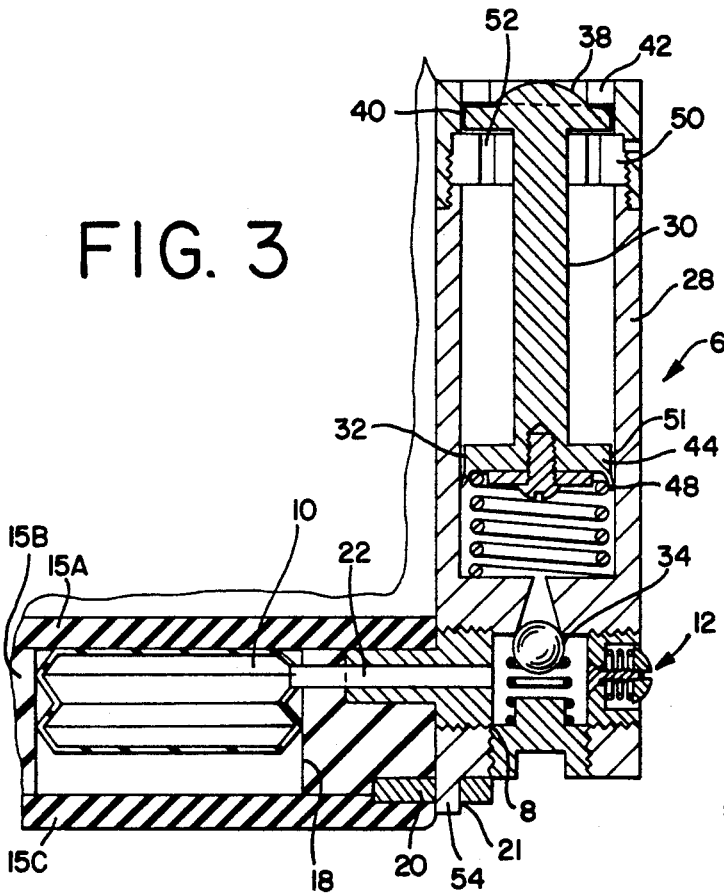
FIG. 3 is a cross section view of the pneumatic inflating device of the present invention in the closed and deflated position.
Figure 5:
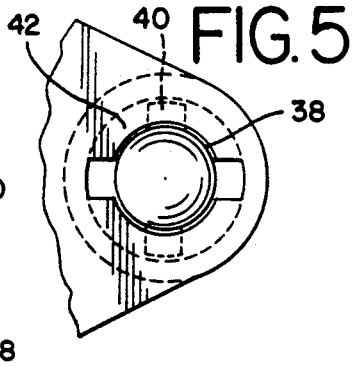
FIG. 5 is a top view, taken along line 5—5, of the pump assembly of the present invention.

The pump assembly 6 is disposed vertically behind the heel of the shoe 4 and is connected to the distribution manifold 8 at the lower end. The pump assembly 6 includes a cylinder housing 28, a plunger 30, a cylinder compression chamber 32, and a ball check valve 34. The plunger 30 includes a rotatable head 38 having paired flanges 40 disposed on each side thereof. As best seen in FIG. 5, the paired flanges 40 are adapted to engage paired flanges 42 disposed in the cylinder housing 28 when the head 38 is rotated. This allows for the plunger 30 to be locked in a down position as shown in FIG. 3 when not in use. The plunger 30 also includes a compression head 44 with a flexible cup 48 attached thereto.

The cylinder housing 28 includes a cylinder head 50 disposed therein to form the compression chamber 32. A pair of vents 52 are disposed through the head 50. A gap 51 is formed between the housing 28 and the head 44. The housing further includes a prong 54 extending from the bottom portion thereof adapted to engage the slot 21 in U-shaped plate 20.

Figure 4:
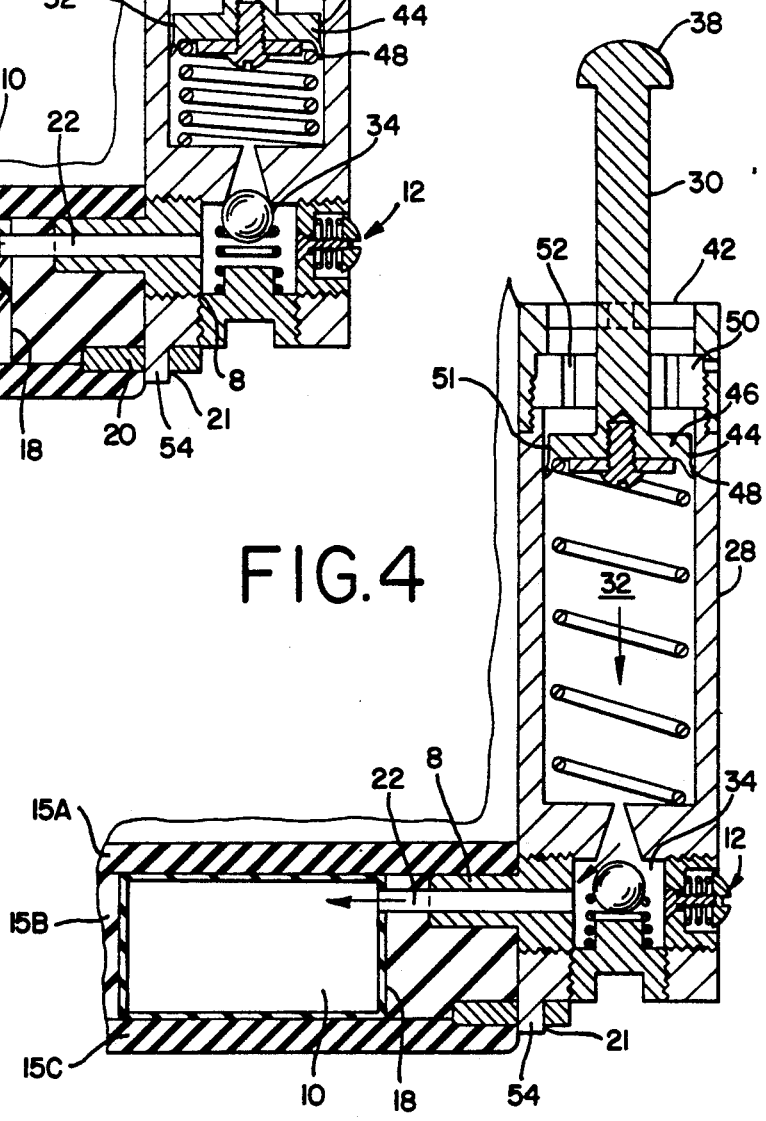
FIG. 4 is a cross section view of the pneumatic inflating device of the present invention in the open inflated position.

The ball check valve 34 allows air to enter the distribution manifold 8 on the downward stroke (see FIG. 3) of the plunger 30 but prevents air from escaping on the upward stroke (see FIG. 4). A release valve assembly 12 is disposed behind the ball check valve 34 and is designed to be opened to release internal pressure from the air cells 10 into the atmosphere and closed to retain air in the cells 10.

The pneumatic inflating device is designed to operate at air pressures of 60 to 100 psi, however pressures outside these parameters are contemplated depending on the weight of the wearer and the materials used in the pneumatic inflating device. In operation, when the shoe 4 is worn by a person, the weight of the individual exerts pressure on the sole 14 of the shoe 4 and compresses the sole 14 between the foot and the ground. The center sole 15B is designed to compress a minimum of one-quarter (¼") inch, thus resulting in the center sole 15B having a thickness of one-half (½") inch. Since the air cells 10 are designed to extend three-quarter (¾") inch when inflated, the air cells 10 will substantially restore the designated height of three-quarter (¾") inch to the center sole 15B after inflation.

To pressurize the pneumatic inflating device 2, the wearer unlocks the plunger 30 at the top of the pump assembly 6. The plunger 30 will spring up when released. On the upward stroke, air will be pulled through the vents 52. The cup 48 will be forced away from the head 44, thereby allowing air to pass through the gap 51 and into the compression chamber 32. When the plunger 30 is depressed, the cup 48 will seal the gap 51 thereby allowing air to be compressed in the cylinder compression chamber 32. The air will then flow through the ball check valve 34 into the distribution manifold 8. The compressed air will then flow through the nipples 24 and into the air cells 10. Continued pumping will fill the air cells 10 and will raise the system pressure which is trapped by the ball check valve 34 to between 60 and 100 psi. As the system pressure rises, the height of the center sole 15B is substantially restored to three-quarter (¾") inch. When walking or running, as the heel of the shoe 4 is raised off the ground, the weight of the user's foot shifts from heel to toe. The system air pressure is maintained constant through all of the air cells by the communication through nipples located at the entrance to each of the air cells 10 with the constriction by the nipples permitting localized increases. The system air pressure can then be adjusted using the release valve assembly 12 and the pumping assembly 6 in combination.

Various features of the invention have been particularly shown and described in connection with the illustrated embodiments of the invention, however, it must be understood that these particular arrangements merely illustrate, and that the invention is to be given its fullest interpretation within the terms of the appended claims.

I claim:

1. A pneumatic inflating device disposed within the sole of a shoe, said pneumatic inflating device including:

a plurality of pairs of oppositely disposed hollow chambers within the sole of the shoe;

a plurality of inflatable air cells, each air cell disposed within one of said hollow chambers;

a pump assembly attached to the shoe;

a plurality of tubes connecting said air cells to said pump assembly;

means for restricting air flow out of said air cells; and means for releasing air from said pneumatic inflating device.

2. A pneumatic inflating device as in claim 1 further including means for locking said pump assembly in a closed position.

3. A pneumatic inflating device as in claim 2 wherein said means for locking said pump assembly in a closed position includes a first pair of flanges disposed on a head of said plunger and a second pair of flanges disposed on said housing whereby when said head is rotated, the first pair of flanges are disposed below the second pair of flanges thereby locking said plunger in position.

4. A pneumatic inflating device as in claim 1 wherein said pump assembly includes a housing forming a cylinder compression chamber, and a plunger disposed within said cylinder compression chamber, said plunger including a rotatable head adapted to be locked in the closed position.

5. A pneumatic inflating device as in claim 1 wherein said plurality of tubes includes a central tube and a plurality of branch tubes, said branch tubes diverging from said central tube and connected to said air cells such that said air cells are connected in a parallel arrangement.

6. A pneumatic inflating device as in claim 1 wherein said means for restricting air flow out of said air cells includes a nipple disposed at the end of each of said tubes.

7. A pneumatic inflating device as in claim 1 wherein said means for releasing air out of said air cells is a release valve assembly.

8. A pneumatic inflating device as in claim 1 wherein said air cells are made from a rubber based product.

9. A pneumatic inflating device as in claim 1 wherein said air cells have a diameter of one (1") inch and a height of three-quarter (¾") inch.

10. A pneumatic inflating device disposed within the sole of a shoe, said pneumatic inflating device including:

a plurality of pairs of oppositely disposed hollow chambers within the sole of the shoe;

a plurality of inflatable air cells, each air cell disposed within one of said hollow chambers;

a pump assembly attached to the shoe;

a plurality of tubes connecting said air cells to said pump assembly;

a plurality of nipples each disposed between said tubes and said air cells, said nipples adapted to restrict air flow out of said cells; and a release valve assembly.

11. A pneumatic inflating device as in claim 10 further including means for locking said pump assemby in a closed position.

12. A pneumatic inflating device as in claim 11 wherein said means for locking said pump assembly in a closed position includes a first pair of flanges disposed on a head of said plunger and a second pair of flanges disposed on said housing whereby when said head is rotated, the first pair of flanges are disposed below the second pair of flanges thereby locking said plunger in position.

13. A pneumatic inflating device as in claim 11 wherein said pump assembly includes a housing forming a cylinder compression chamber, and a plunger disposed within said cylinder compression chamber, said plunger including a rotatable head adapted to be locked in the closed position.

14. A pneumatic inflating device as in claim 11 wherein said plurality of tubes includes a central tube and a plurality of branch tubes, said branch tubes diverging from said central tube and connected to said air cells such that said air cells are connected in a parallel arrangement.

15. A pneumatic inflating device as in claim 11 wherein said air cells are made from a rubber based product.

16. A pneumatic inflating device as in claim 11 wherein said air cells have a diameter of one (1″) inch and a height of three-quarter ($\frac{3}{4}$″) inch.

* * * * *